US007215072B2

(12) United States Patent
Koga et al.

(10) Patent No.: US 7,215,072 B2
(45) Date of Patent: May 8, 2007

(54) FIELD-EMISSION ELECTRON SOURCE, METHOD OF MANUFACTURING THE SAME, AND IMAGE DISPLAY APPARATUS

(75) Inventors: Keisuke Koga, Soraku-gun (JP); Makoto Yamamoto, Takarazuka (JP); Akinori Shiota, Ibaraki (JP); Seigo Kanemaru, Tsukuba (JP); Masayoshi Nagao, Tsukuba (JP)

(73) Assignees: Matsushita Electric Industrial Co., Ltd., Osaka (JP); National Institute of Advanced Industrial Science and Technology, Tokyo (JP)

( * ) Notice: Subject to any disclaimer, the term of this patent is extended or adjusted under 35 U.S.C. 154(b) by 89 days.

(21) Appl. No.: 10/806,803

(22) Filed: Mar. 23, 2004

(65) Prior Publication Data

US 2004/0189176 A1 Sep. 30, 2004

(30) Foreign Application Priority Data

Mar. 24, 2003 (JP) ..... 2003-081188

(51) Int. Cl.
*H01J 1/05* (2006.01)

(52) U.S. Cl. ..... 313/495; 313/309; 313/336; 313/351

(58) Field of Classification Search ..... 313/309, 313/310, 336, 351, 495, 497, 413, 421, 409
See application file for complete search history.

(56) References Cited

U.S. PATENT DOCUMENTS 4,178,531 A * 12/1979 Alig ..... 313/409
5,393,647 A * 2/1995 Neukermans et al. ..... 430/320
5,663,611 A * 9/1997 Seats et al. ..... 313/584
5,869,169 A * 2/1999 Jones ..... 428/213
6,091,190 A * 7/2000 Chalamala et al. ..... 313/346 R
6,333,724 B1 * 12/2001 Taira et al. ..... 345/5
6,356,014 B2 * 3/2002 Xu et al. ..... 313/497
6,417,617 B2 * 7/2002 Zhang et al. ..... 313/495
6,570,305 B1 * 5/2003 Urayama et al. ..... 313/311

FOREIGN PATENT DOCUMENTS

JP 2-220337 9/1990

* cited by examiner

*Primary Examiner*—Ashok Patel
(74) *Attorney, Agent, or Firm*—Hamre, Schumann, Mueller & Larson, P.C.

(57) ABSTRACT

A stable field-emission electron source that does not suffer from a current drop even after a high-current density operation for a long time is provided. The field-emission electron source includes: a substrate; an insulating layer that is formed on the substrate and that has a plurality of openings; cathodes arranged at the respective openings in order to emit electron beams; a lead electrode formed on the insulating layer in order to control emission of electrons from the respective cathodes; and a surface-modifying layer formed on the surface of each of the cathodes emitting electrons, comprising a chemical bond between a cathode material composing the cathodes and a material different from the cathode material.

15 Claims, 3 Drawing Sheets

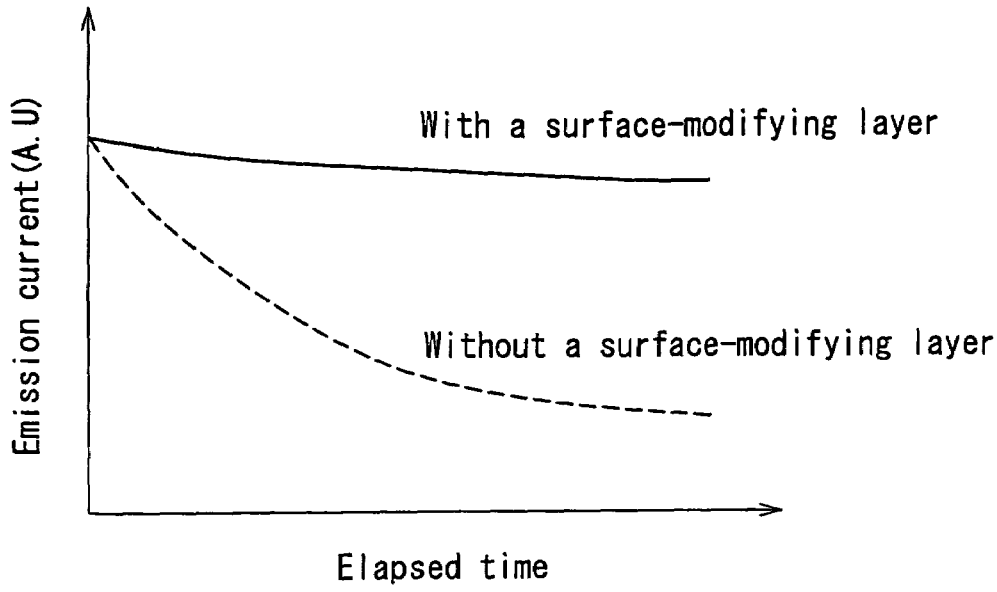
FIG. 3
FIG. 4
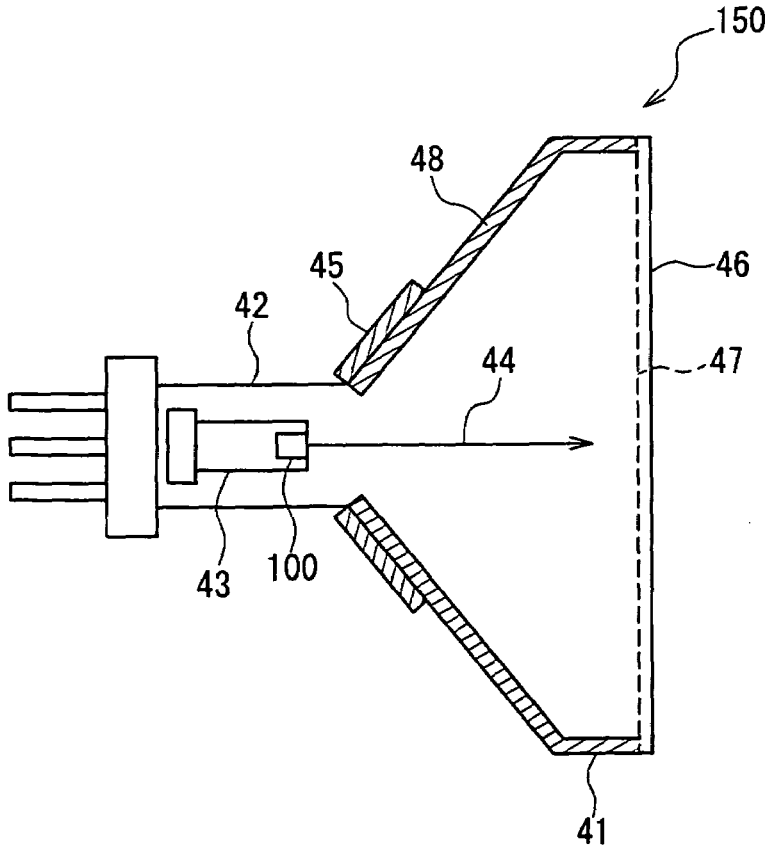

FIELD-EMISSION ELECTRON SOURCE, METHOD OF MANUFACTURING THE SAME, AND IMAGE DISPLAY APPARATUS

BACKGROUND OF THE INVENTION

1. Field of the Invention

The present invention relates to a cathode ray tube (CRT) used in a color television or a high-definition monitor television and further to an electron gun used in an electron beam exposure device or the like that utilizes a converged electron beam. In particular, the present invention relates to a field-emission electron source used in an electron gun of a highly bright CRT requiring a high current density operation, and an image display apparatus using the same.

2. Description of Related Art

In recent years, with the advent of thin-type displays such as liquid crystal displays or plasma displays, the flat display market has been growing rapidly, though CRT displays still hold an edge in price and performance for application to home televisions about 32 inch diagonal in size.

Furthermore, terrestrial digital broadcasting was newly introduced at full scale in 2003, and there has been a drastic change in the technologies of television displays. With televisions and their surroundings making a transition to a digital system, displays have been required strongly to have high-resolution performance.

However, the television technology that has been used widely so far might not be able to respond to such a demand sufficiently. An electron gun is used in a television as a main portion for displaying an image, and its performance is closely related to the resolution performance.

By increasing a current density of a cathode used in the electron gun, it becomes possible to reduce an effective area of the cathode, thereby improving the resolution performance. Although various technological improvements on a thermal cathode material that is currently used as the cathode of the electron gun have been made to increase the current density, such improvements have come close to their physical limits and no more dramatic increase in the current density can be expected.

A cathode in an electron gun for digital broadcasting, which has been proceeding toward a practical use in recent years, requires about 6 to 10 times as large a current density as a conventional thermal cathode. Accordingly, there are increasing expectations for a cold cathode as a technology for achieving a considerable increase in the current density.

This cold cathode is generally manufactured by using a semiconductor process. Since this process is advantageous in that a cathode having a minute structure on a sub-micron order or smaller can be integrated at a high density, the current density can be increased. Therefore, this cold cathode has been applied to products such as field-emission display apparatuses or the like.

In general, a refractory metal (high-melting-point metal) such as molybdenum often is used as a material for the cold cathode. After the completion of CRT manufacturing process, the vacuum level inside the CRT usually is about $10^{-4}$ Pa owing to constraints in the manufacturing processes and the structure of the CRT. When the cold cathode is operated at a current density of about 10 A/cm$^2$ under such a vacuum environment, the following problem arises.

Inside the CRT, there are various kinds of residual gases that have been generated in the manufacturing process. It is known that oxygen (O) and carbon (C) among the constituent elements of the residual gases temporarily adhere to an emitter surface or change a composition of the emitter surface, thereby lowering the emission performance of the cold cathode.

For the above-mentioned object, Japanese Patent No. 2718144 discloses a concept regarding stabilization of an emission current by arranging, on a surface of a cathode, a chemically-stable resistance material having a low work function. A configuration of the conventional example will be described below by referring to FIG. 6.

FIG. 6 is a cross-sectional view to show a configuration of a conventional field-emission electron source 90.

On a conical tungsten cold cathode base 92, a film 82 of $La_2O_3$ as one of the low work function oxides is coated to a thickness of about 10 nanometers, thereby forming a field-emission cold cathode 83. In the vicinity, a lead electrode 93 having a through hole 95 with a diameter of about 1 μm is formed on an insulating layer 94 applied on a substrate 96. When a voltage of about 60 V is applied between the cold cathode base 92 and the lead electrode 93, electrons are emitted from the surface of the cold cathode base 92.

When the voltage was raised to 80 V, an emission electron current of 1 μA was obtained. With respect to the change of the emission electron current over time, fluctuation of the emission electron current was within 5% regardless of the vacuum level of $1\times10^{-7}$ Torr. Afield-emission cold cathode based on this system can provide a relatively stable operation in comparison with a conventional cold cathode having no $La_2O_3$ film, as the conventional cold cathode has a fluctuation of the emission electron current ranging from 30% to 40%.

The above effect is obtained due to a negative feedback from the $La_2O_3$ resistance film coated on the electrode surface. More specifically, the internal resistance of the $La_2O_3$ film prevents the electron emission from concentrating at a point, but the electrons are emitted from the entire surface of the sharpened top portion of the cold cathode. Moreover, the $La_2O_3$ film is stable with respect to the residual gas, and furthermore, an operation at a low voltage serves to decrease damage caused by the sputtering.

However, experimental results of studies by the inventors revealed that the above-mentioned conventional method can cause a problem as mentioned below.

Though JP 2718144 has no specific description about a method of forming a $La_2O_3$ resistance film, in many cases, a vacuum deposition method used for a process of manufacturing a semiconductor or a plasma sputtering that uses an argon (Ar) gas can be applied for forming a thin film of about 10 nanometers in thickness.

When such a film formation process is used for coating a $La_2O_3$ film 82 about 10 nanometers in thickness on a surface of a cold cathode base 92 so as to form a field-emission cold cathode 83, the $La_2O_3$ film 82 is applied partially on the surface of the insulating layer 94 at an opening in the lead electrode 93 as well as on the surface of the cold cathode base 92. The $La_2O_3$ film 82 formed on the surface of the insulating layer 94 will degrade the withstand voltage between the cold cathode base 92 and the lead electrode 93.

When a voltage of about 60 V is applied between the cold cathode base 92 and the lead electrode 93 in this state, a leakage current will occur between the cold cathode base 92 and the lead electrode 93, and this can prevent application of a normal voltage. This problem will degrade a stable field-emission characteristic.

Use of the $La_2O_3$ film 82 having an internal resistance is advantageous in that a comparatively stable operation is available regarding a current emission. However, due to the rise in the cathode surface potential caused by the internal resistance, an effective voltage between the cold cathode base 92 and the lead electrode 93 is decreased, resulting in a disadvantage, that is, an increase in the operation voltage.

The stabilization method using the internal resistance also is referred to as a ballast effect caused by a load resistance. Since the stabilization effect provided by increased internal resistance and the rise in the effective voltage are in a trade-off relationship, the stabilization has been difficult to optimize.

In a silicon minute structure cold cathode that includes a silicon substrate as a cold cathode base and that has the top portion sharpened by thermal oxidation, the top portion generally has a radius of curvature uniformly controlled to a level of several nanometers or less. When a $La_2O_3$ film having a thickness of about 10 nanometers is coated on the cathode surface of the silicon minute structure cold cathode according to a conventional method, the radius of curvature of the top portion of the cathode is decreased before the coating step. The radius of curvature can be multiplied occasionally by several dozens. Since the radius of curvature of the top portion of the cathode can have a great influence on the field-emission characteristic in light of the operation principle, the field-emission characteristic may deteriorate considerably.

SUMMARY OF THE INVENTION

Therefore, with the foregoing in mind, it is an object of the present invention to provide a stable field-emission electron source that does not suffer from a current drop even after a high-current density operation for a long time, and a method of manufacturing the same.

Another object of the present invention is to provide a high-performance image display apparatus that can maintain stable image display performance over a long period of time.

For achieving the above-identified objects, a field-emission electron source of the present invention includes a substrate, an insulating layer that is formed on the substrate and that has a plurality of openings, cathodes that are arranged at the respective openings in order to emit electron beams, a lead electrode formed on the insulating layer in order to control emission of the electrons from the respective cathodes, and a surface-modifying layer formed on the surface of each of the cathodes emitting the electrons. The surface-modifying layer comprises a chemical bond between a cathode material composing the cathode and a material different from the cathode material.

A method of manufacturing a field-emission electron source of the present invention includes steps of etching a surface of each cathode in order to remove an oxide layer formed on the surface; and forming a surface-modifying layer on the surface of the cathode by a plasma treatment. The surface-modifying layer comprises a chemical bond between the cathode material and a material different from the cathode material.

An image display apparatus according to the present invention is arranged inside a vacuum container, and includes an electron gun having the field-emission electron source of the present invention, and a phosphor layer to be irradiated with the electron beams emitted from the electron gun.

BRIEF DESCRIPTION OF THE DRAWINGS

FIG. 3 is a graph showing a relationship between elapsed time and an emission current emitted from the field-emission electron source according to the FIG. 4 is a cross-sectional view showing a configuration of an image display apparatus according to a second embodiment.

DETAILED DESCRIPTION OF THE INVENTION

A field-emission electron source according to the present embodiments includes a surface-modifying layer that is formed on cathodes that emit electrons, and the surface-modifying layer comprises a chemical bond between a cathode material composing the cathodes and a material different from the cathode material. Therefore, the surface composition of the cathode material can be modified chemically in an optimum manner without damaging the cathode structure, so that electrons can be emitted from the cathodes in a stable and preferable manner.

It is preferable that the cathodes are made of silicon (Si).

It is preferable that the surface-modifying layer comprises a chemical bond between the cathode material and a material whose sputtering rate with respect to argon is lower than that of the cathode material.

It is preferable that the surface-modifying layer comprises a chemical bond between silicon and carbon.

It is preferable that the substrate is made of silicon.

It is preferable that the cathodes are made of molybdenum.

It is preferable that the cathodes are arrayed on the substrate.

It is preferable that each of the cathodes is shaped substantially like a cone.

A method of manufacturing a field-emission electron source according to the present embodiments includes a step of forming a surface-modifying layer on a surface of each cathode by a plasma treatment, where the surface-modifying layer comprises a chemical bond between a cathode material and a material different from the cathode material. Therefore, the surface composition of the cathode material can be modified chemically in an optimum manner without damaging the cathode structure, so that electrons can be emitted from the cathodes in a stable and preferable manner.

It is preferable that the method further includes a step of removing an impurity deposit layer from the surface of the surface-modifying layer by etching with a reactive gas containing at least oxygen as an element.

It is preferable that the impurity deposit layer is a fluorocarbon layer.

An image display apparatus according to the present invention includes an electron gun that is arranged inside a vacuum container and has a field-emission electron source of the present invention, so that electrons can be emitted from the cathodes in a stable and preferable manner.

It is preferable that a deflector for deflecting the electron beams is further provided, so that the electron beam deflected by the deflector is radiated on the phosphor layer.

The following is a more specific description of embodiments of the present invention, with reference to the accompanying drawings.

(First Embodiment)

Figure 1:
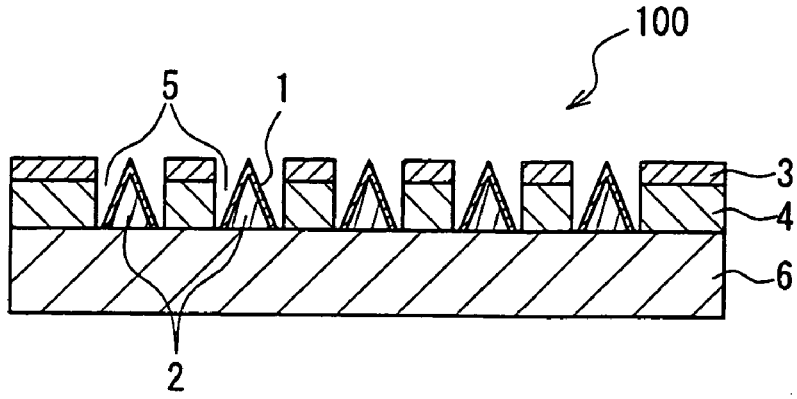
FIG. 1 is a cross-sectional view showing a configuration of a field-emission electron source according to a first embodiment.

FIG. 1 is a cross-sectional view showing a configuration of a field-emission electron source 100 according to a first embodiment. The field-emission electron source 100 includes a substrate 6. On the substrate 6, a lead electrode 3 for controlling electron emission is formed via an insulating layer 4 having circular openings 5 at arrayed regions for forming cathodes.

Optimum materials such as generally-used glass substrates and silicon substrates can be used for the substrate 6 in light of the characteristics of the field-emission electron source and the process conditions.

Inside each of the openings 5 formed in both the insulating layer 4 and the lead electrode 3, a conical cathode 2 is formed as an electron-emitting portion. Therefore, a field-emission electron source array consisting of a plurality of cathodes 2 is formed on the entire surface of the substrate 6 or any region as desired.

Although the description does not particularly go into detail on a material and a structure of the electron-emitting portion, for example, a conventionally-used Spindt-type electron source formed by vapor deposition of molybdenum, and a silicon electron source formed by utilizing a silicon semiconductor process, can be used.

A surface-modifying layer 1 is formed on either the cathodes 2 or on at least one part including the electron-emitting portion. Optimum materials can be selected for composing the surface-modifying layer 1 in accordance with the material of the electron-emitting portion as the base, or the type of the gas of the oxidizing atmosphere in which the field-emission electron source will be arranged.

In an example of the first embodiment, silicon is used for the material of the electron-emitting portions, and the surface-modifying layer 1 is in a stable condition where silicon (Si) and a carbon (C) element are bonded chemically. When the substrate 6 is made of silicon, the electron-emitting portions that serve as the cathodes 2 are also made of silicon in general.

A Spindt-type electron source formed by molybdenum vapor deposition or the like can be handled as in the case of a silicon electron source, by forming a surface coating film of silicon on a surface of each of the electron-emitting portions composing the cathodes 2.

As mentioned earlier, a silicon material has a tendency of reacting easily with the constituent composing the oxidizing gas atmosphere so as to form a $SiO_2$ film as an oxide film. Upon exposing a dean silicon surface to the air at ordinary temperature, a $SiO_2$ film of several atomic layers is formed on the surface within a few minutes.

The vacuum level inside a CRT usually is about $10^{-4}$ Pa owing to constraints in the manufacturing processes and a structure of the CRT. A large amount of oxidizing gas such as $H_2O$ and $CO_2$ also is contained in the residual gas inside the CRT. When the cold cathode is operated at a current density of about 10 A/cm$^2$ under such a vacuum environment, the silicon surface of the field-emission electron source serving as an operation region of the cathode is activated by an ion generated by a collision with emitted electrons and with the residual gas. Recent studies conducted by the inventors have revealed that, even in the vacuum environment, the activated silicon surface and the ionized oxidizing gas easily form a chemical bond, so that the $SiO_2$ film as the oxide film covers the outermost silicon surface. The thus formed oxide film poses the greatest technological problem in utilizing the silicon materials as the CRT cathode.

Regarding a silicon material, the surface is slightly etched with a diluted hydrogen fluoride solution so as to remove a natural oxide film from the surface, thereby providing an active surface condition. By exposing the activated silicon surface to an active and radical elemental atmosphere containing carbon, an extremely stable surface-modifying layer containing chemically-bonded silicon and carbon can be obtained.

Figure 2:
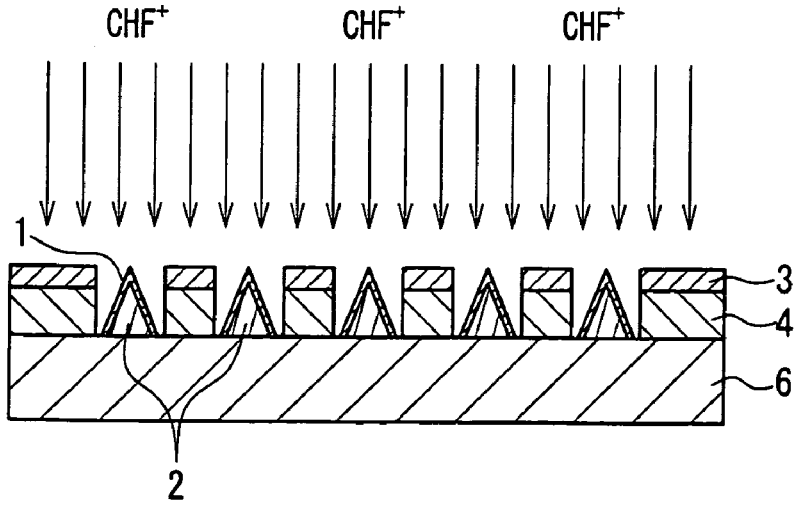
FIG. 2 is a cross-sectional view for showing a process of manufacturing the field-emission electron source according to the first embodiment.

A process of forming a stable surface-modifying layer on a silicon surface will be described briefly below. FIG. 2 is a cross-sectional view showing a process of manufacturing a field-emission electron source according to the first embodiment. First, after manufacturing a field-emission electron source including silicon for cathodes, the whole electron source is dipped for 10 seconds at most in a hydrogen fluoride solution diluted to about 5%, thereby removing the natural oxide film from the surface.

In the next step as shown in FIG. 2, a plasma exposure is carried out in the following manner. A reactive ion etching (RIE) apparatus is used to expose (plasma exposure) under a predetermined condition to a plasma atmosphere containing $CHF_3$ as an etching gas, thereby forming a surface-modifying layer 1 on a silicon surface, containing silicon and carbon chemically bonded to each other.

For analyzing the condition of the silicon surface modified under the condition, a XPS spectrum analysis was carried out to confirm a peak for a value of a bonding energy in the vicinity 283.5 electron volts (eV). As a result, the surface-modifying layer 1 was confirmed to be based on a SiC composition.

For verifying the effect of the surface-modifying layer 1, the field-emission electron source was continuously operated in a vacuum chamber atmosphere containing a small amount of oxidizing gas such as $H_2O$, thereby permitting a comparison of the stability of the current.

FIG. 3 is a graph showing an experimental result for a field-emission electron source with a surface-modifying layer 1 formed of a SiC composition containing silicon and carbon chemically bonded to each other. In a comparison between a field-emission electron source having the surface-modifying layer 1 and a field-emission electron source without the surface-modifying layer 1 under the same condition of the current load and the same chamber condition (oxidizing gas atmosphere), a considerable difference was found in the current stability.

It was confirmed that the emission current is decreased over time for the field-emission electron source without a surface-modifying layer, while the field-emission electron source having the surface-modifying layer 1 was operated stably with less decrease in the emission current.

A physical analysis on the surfaces of the field-emission electron sources indicated that the surface of the emission region of the field-emission electron source without a surface-modifying layer was covered with a $SiO_2$ film, and this was confirmed as a chief factor for the current decrease.

It was confirmed from the experimental analyses that since the surface-modifying layer 1 composed of a SiC composition suppresses oxidation caused by the oxidizing gas, the field-emission electron source having the surface-modifying layer 1 operates stably.

It should be also noted that, in comparison with silicon, carbon has a smaller sputtering rate with respect to an argon ion. Therefore, in comparison with a surface composed of silicon alone, a surface-modifying layer 1 composed of an extremely stable SiC composition containing silicon and carbon chemically bonded to each other has an improved resistance also to sputtering damage caused by an argon ion as a main constituent of the residual gas, and thus the surface-modifying layer 1 is effective for a stable emission operation over a long period of time.

In the plasma exposure process as described in the first embodiment, silicon is used for the material of the cathodes 2, and a silicon oxide film is used for the insulating layer for the lead electrode 3. In this case, since the surface modification reaction occurs selectively on the silicon surface alone, a SiC film will not be formed on the surface of the insulating layer. Therefore, a stable emission operation is available since degradation of the voltage endurance characteristics in the insulating layer, which has been a problem to be solved in conventional techniques, will not occur.

In the first embodiment mentioned above, silicon is used for the material of the field-emission electron source, and the surface-modifying layer 1 is made of stable SiC in which silicon and carbon are chemically bonded to each other. The present invention is not limited to these examples, but any surface-modifying layers made of suitable materials can be selected depending on the selected materials of a field-emission electron source.

For example, the surface-modifying layer 1 can comprise a chemical bond between carbon (C) and a transition metal such as titanium (Ti), vanadium (V), chromium (Cr), molybdenum (Mo), niobium (Nb), zirconium (Zr), hafnium (Hf), tantalum (Ta) and tungsten (W). A similar effect can be obtained by a combination of any of these transition metals and nitrogen (N). In such a case, heating should be carried out in a process of forming a surface-modifying layer comprising a chemical bond between a transition metal and carbon (C)/nitrogen (N) on the surface of the cathode by a plasma treatment.

The surface-modifying layer 1 comprising a chemical bond between the transition metal and nitrogen (N) will be formed by using a plasma atmosphere containing a nitrogen ($N_2$) gas and ammonia ($NH_3$) in place of a plasma atmosphere containing $CHF_3$.

Though a plasma atmosphere containing $CHF_3$ as an etching gas is described in the first embodiment, the present invention is not limited to the example. The $CHF_3$ for the plasma atmosphere can be replaced by a gaseous mixture of $CF_4$ and $H_2$, or a combination of $C_2H_6$ and a $H_2$ gas. Furthermore, by raising the substrate temperature, even a plasma atmosphere containing a $CH_4$ gas can be used for forming SiC.

The first embodiment has been described referring to the example in which the image display apparatus is applied to a representative cathode ray tube (CRT). However, the application is not limited to the cathode ray tube, but the image display apparatus also is applicable to high-intensity light-emitting display tubes for outdoor use or light-emitting display tubes for illumination, for example.

As mentioned above, the field-emission electron source of the first embodiment includes a surface-modifying layer 1 that is formed at least on one part of a cathode surface including an electron-emission region and that is extremely stable due to a chemical bond between silicon and carbon. Since the thus configured field-emission electron source effectively prevents oxidation of the cathode surface, and improves resistance to sputtering damage caused by an argon ion as a main constituent of the residual gas, stable performance in electron emission can be maintained.

Thereby, by using the field-emission electron source according to the first embodiment, the surface composition of the cathode material can be modified chemically in an optimum manner without damaging the structure of the cathodes, and thus a stable and preferable electron emission can be maintained.

(Second Embodiment)

An image display apparatus 150 according to a second embodiment of the present invention will be described below by referring to FIG. 4. As shown in FIG. 4, the image display apparatus 150 includes a bulb 41 and an electron gun 43 provided in a neck 42 of the bulb 41. An electron beam 44 emitted from the electron gun 43 is scanned by a deflection yoke 45 mounted on an outer periphery of a funnel and irradiated on a phosphor layer 47 attached to an inner surface of a face panel 46, thus forming an image over an entire surface of the face panel 46.

Furthermore, an inner surface of the funnel is provided with an electrically conductive material 48. This electrically conductive material 48 is typically formed of an electrically conductive paste made of a carbon material in order to keep the potential constant between the neck 42 and the face panel 46 to which a high voltage of about 30 kV is applied. For the cold cathode for the electron gun 43 used in the second embodiment, the field-emission electron source 100 mentioned in the first embodiment is used.

As mentioned in the first embodiment, a surface-modifying layer 1 is formed on the surface of the cathodes 2 composing the electron-emitting portions, or at least on a part of the surface including the electron-emitting portions. The surface-modifying layer 1 includes a SiC film having an extremely stable composition in which silicon and carbon are chemically bonded to each other.

The level of vacuum inside the bulb 41 of the CRT as the image display apparatus 150 described in the second embodiment is about $10^{-4}$ Pa owing to constraints in the manufacturing processes and the internal structure of the CRT. For the residual gas in the CRT, a large volume of oxidizing gases such as $H_2O$ and $CO_2$ are contained as well.

Under this level of vacuum environment, the cold cathode of the electron gun 43 is operated at a current density of about 10 $A/cm^2$, so that the silicon surface of the field-emission electron source as an operation region of the cold cathode will be activated by an ion generated by a collision with emitted electrons and the residual gas.

Regarding a typical field-emission electron source unrelated to the example of the present invention, i.e., a field-emission electron source without the surface-modifying layer 1, the activated silicon surface and the ionized oxidizing gas molecules are chemically bonded to each other easily. Thus the outermost surface of the silicon will be covered with a $SiO_2$ film as an oxide film.

On the other hand, since at least the surface of the electron-emitting portion in the field-emission electron source according to the second embodiment is covered with a SiC film having an extremely stable composition provided by a chemical bond, the surface will not be oxidized easily even when an activated ion is generated, and thus the electron emission performance can be maintained to be extremely stable.

A CRT was manufactured for evaluations of the current stability in a continuous operation. It was confirmed in the experiment that the stable performance in electron emission was obtainable over a long period of time.

As mentioned above, since an image display apparatus according to the second embodiment includes a field-emission electron source 100 used as a cathode of the electron gun 43 and since the field-emission electron source 100 has a chemically-stable surface-modifying layer 1, it can prevent effectively the influence of a chemical reaction with the active residual gas within the vacuum container used for a CRT or the like or physical damage caused by sputtering due to the residual gas ions. Thereby, a long-life operation and a stable operation can be achieved in a highly effective manner.

The second embodiment has been described referring to the example in which the image display apparatus is applied to a representative cathode ray tube (CRT). The application is not limited to the cathode ray tube, but the image display apparatus also is applicable to high-intensity light-emitting display tubes for outdoor use or light-emitting display tubes for illumination, for example.

As mentioned above, the image display apparatus according to the second embodiment includes a field-emission electron source having on the surface a chemically-stable surface-modifying layer, thus it can prevent effectively performance degradation caused by oxidation of the field-emission electron source and ion-impact damage. The thus manufactured image display apparatus has an excellent ion impact resistance and it realizes stable electron emission over a long period of time, thereby maintaining stable image display performance.

(Third Embodiment)

Figure 5:
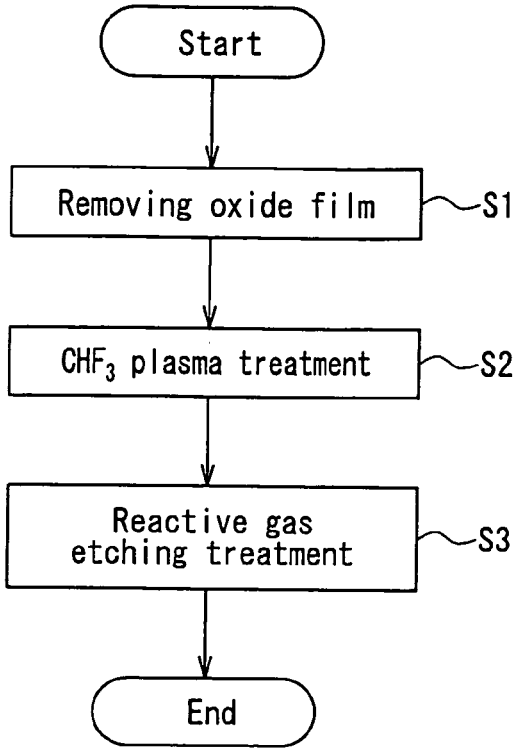
FIG. 5 is a flow chart showing a process of manufacturing a field-emission electron source according to a third embodiment.
Figure 6:
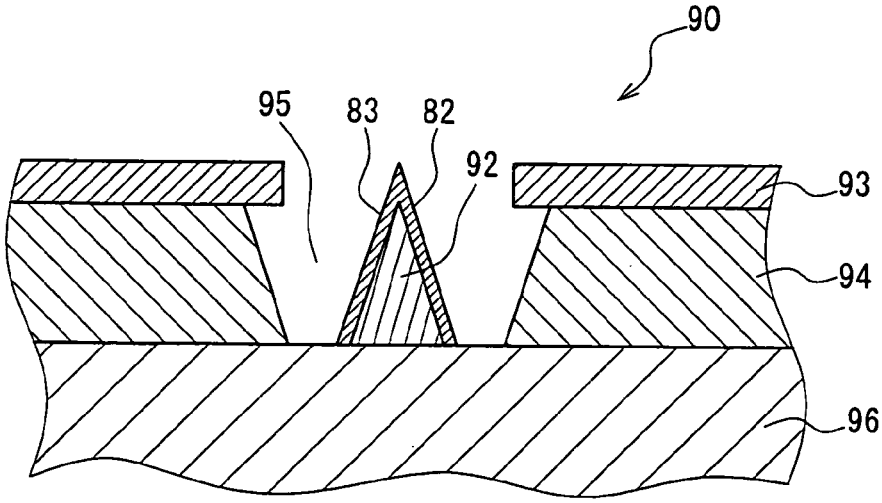
FIG. 6 PRIOR ART
FIG. 6 is a cross-sectional view showing a configuration of a conventional field-emission electron source.

A process of manufacturing a field-emission electron source according to a third embodiment will be explained below by referring to a flow chart of FIG. 5. Specifically, the third embodiment refers to a case of using silicon as the material of the field-emission electron source.

First, as indicated in Step S1, a natural oxide film formed on a silicon surface of the field-emission electron source is removed. After finishing the field-emission electron source using the silicon as cathodes, the entire electron source is dipped for about 10 seconds in a hydrogen fluoride solution diluted to 5%. Accordingly, the natural oxide film on the silicon is removed, thereby providing a dean and active surface terminated with an OH group.

Next, as indicated in Step S2, a surface-modifying layer is formed on the silicon surface by a plasma treatment. After the removal of the natural oxide layer, preferably, the clean silicon surface is subjected to the plasma treatment as quickly as possible, since another natural oxide film would be formed again within tens of minutes when the silicon surface is exposed to the air.

A typical condition for the plasma treatment will be described below. For the apparatus, a reactive ion etching apparatus generally used for a process of etching semiconductors is used. The process condition includes a $CHF_3$ gas flow rate of 80 sccm, a gas pressure of 2.5 Pa, a RF power of 80 W, and a plasma exposure time of 15 seconds.

On a silicon surface exposed to plasma under this condition, a SiC layer of several atomic layers is formed uniformly on the silicon interface, and further a fluorocarbon layer containing CHF as an element of about several nanometers is formed thereon.

In an analysis on the bonding condition of the surface-modifying layer by a XPS spectrum, a 283.5 eV spectrum indicating a Si—C bond was found on the interface with silicon. Therefore, it was confirmed that a SiC layer having a chemically stable bond was formed uniformly.

The fluorocarbon layer formed on the layer of stable Si—C is made of a stable substance, and thus it serves as a protective film for preventing an oxidation reaction. However, results of recent studies conducted by the inventors revealed that the fluorocarbon layer will be decomposed easily and evaporate when subjected to a temperature of 300° C. or higher under a vacuum atmosphere. Moreover, the fluorocarbon layer based on carbon as an electrically conductive material can cause a considerable degradation in the voltage resistance and reliability of the field-emission electron source. Therefore, the fluorocarbon layer was removed in the following process.

As indicated in Step S3, the fluorocarbon layer on the outermost surface was removed selectively by etching using a reactive gas. The following conditions were selected for the process in order to prevent degradation of the minute structure of the sharpened top of each of the electron-emitting portions of the field-emission electron source, which is caused by the plasma treatment, and also to select a condition for preventing the etching from affecting the SiC layer disposed under the fluorocarbon layer.

Like the above-mentioned Step S2, a reactive ion etching apparatus was used. The process condition included an $O_2$ gas flow rate of 80 sccm, a gas pressure of 5 Pa, a RF power of 80 W, and a plasma exposure time of 30 seconds. Under this condition, only the fluorocarbon layer on the silicon surface was removed selectively, and thus a clean surface-modifying layer of SiC was formed on the silicon surface.

According to the method of manufacturing a field-emission electron source of the third embodiment of the present invention, the electron-emitting surface made of silicon is covered uniformly with an extremely-thin and stable SiC modifying film having an improved crystalline structure, and thus a stable electron emission characteristic can be obtained without degrading the electron emission performance. It is preferable that this SiC modifying film has a thickness ranging from about 0.5 nm to several nanometers.

Since the surface-modifying layer of the SiC composition according to the third embodiment has a covalent crystalline structure in which Si and C are bonded to each other more rigidly in comparison with a SiC surface-coating layer formed by any of conventional techniques such as a CVD method or a sputtering method, it has excellent oxidation resistance and ion-impact resistance. Therefore, the life property of the field-emission electron source can be improved remarkably.

Furthermore, by selectively removing the fluorocarbon layer formed at the same time of the $CHF_3$ plasma treatment, desirable field-emission electron characteristics including excellent voltage resistance and reliability can be obtained.

As mentioned above, in the method of manufacturing a field-emission electron source according to the third embodiment, an electron emission surface made of silicon is covered uniformly with an extremely thin SiC modified film having an improved crystalline structure and being stable, and thus a stable electron emission characteristic can be obtained without degrading the electron emission performance. Furthermore, the method enables selective removal of an outermost fluorocarbon layer that can lower a withstand voltage between the lead electrode and the cathode, thereby providing an electron emission characteristic including excellent voltage resistance and reliability.

As mentioned above, the present invention can provide a stable field-emission electron source that does not suffer from a current drop even after a high-current density operation for a long time, and a method of manufacturing the same.

Furthermore, the present invention can provide a high-performance image display apparatus that can maintain a stable image display performance over a long period of time.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, all changes that come within the meaning and range of equivalency of the claims are intended to be embraced therein.

What is claimed is:

1. A field-emission electron source comprising:

a substrate, an insulating layer that is formed on the substrate and has a plurality of openings, cathodes arranged at the respective openings to emit electron beams, a lead electrode formed on the insulating layer to control emission of the electrons from the cathodes; and a surface-modifying layer having a substantially uniform thickness formed on a surface of each of the cathodes emitting the electrons, the surface-modifying layer comprising a chemical bond between a cathode material composing the cathodes and a material different from the cathode material.

2. The field-emission electron source according to claim 1, wherein the cathodes comprise silicon.

3. The field-emission electron source according to claim 1, wherein the surface-modifying layer comprises a chemical bond between the cathode material and a material whose sputtering rate with respect to argon is lower than a sputtering rate of the cathode material.

4. The field-emission electron source according to claim 3, wherein the cathode material comprises silicon, the material whose sputtering rate with respect to argon is lower than the sputtering rate of the cathode material comprises carbon, and the chemical bond of the surface-modifying layer comprises a bond between the silicon of the cathode material and the carbon of the material whose sputtering rate with respect to argon is lower than the sputtering rate of the cathode material.

5. The field-emission electron source according to claim 3, wherein the cathode material comprises molybdenum, the material whose sputtering rate with respect to argon is lower than the sputtering rate of the cathode material comprises carbon, and the chemical bond of the surface-modifying layer comprises a bond between the molybdenum of the cathode material and the carbon of the material whose sputtering rate with respect to argon is lower than the sputtering rate of the cathode material.

6. The field-emission electron source according to claim 1, wherein the surface-modifying layer comprises a chemical bond between silicon and carbon.

7. The field-emission electron source according to claim 1, wherein the substrate comprises silicon.

8. The field-emission electron source according to claim 1, wherein the cathodes comprise molybdenum.

9. The field-emission electron source according to claim 1, wherein the cathodes are arrayed on the substrate.

10. The field-emission electron source according to claim 1, wherein each of the cathodes is shaped substantially like a cone.

11. The field-emission electron source according to claim 1, wherein the surface-modifying layer is formed by exposing the surface of each of the cathodes to a plasma treatment.

12. The field-emission electron source according to claim 1, wherein the surface-modifying layer has a covalent crystalline structure.

13. An image display apparatus comprising:

an electron gun arranged inside a vacuum container and provided with the field-emission electron source according to claim 1; and a phosphor layer to be irradiated with the electron beam emitted from the electron gun.

14. The image display apparatus according to claim 13, further comprising a deflector for deflecting the electron beam, wherein the electron beam deflected by the deflector is radiated on the phosphor layer.

15. A field-emission electron source comprising:

a substrate;

an insulating layer formed on the substrate and having a plurality of openings;

a plurality of cathodes operable to emit electron beams, the plurality of cathodes arranged at the plurality of openings, respectively;

a lead electrode operable to control emission of the electron beams from the cathodes, the lead electrode formed on the insulating layer; and a material, which is different from a cathode material composing the cathodes, chemically bonded to the cathode material on a surface of each of the cathodes by exposing each of the cathodes to a plasma treatment, the chemically bonded material and cathode material constituting a surface-modifying layer having a substantially uniform thickness.

* * * * *